United States Patent [19]

Flaherty

[11] Patent Number: 4,502,264

[45] Date of Patent: Mar. 5, 1985

[54] FILM WRAP MACHINE

[76] Inventor: Anthony H. Flaherty, 7365 Thornapple Pines SE., Grand Rapids, Mich. 49506

[21] Appl. No.: 879,380

[22] Filed: Feb. 21, 1978

[51] Int. Cl.[3] ..... B65B 11/04

[52] U.S. Cl. ..... 53/399; 53/441; 53/556; 53/587

[58] Field of Search ..... 53/441, 556, 587, 211, 53/399

[56] References Cited

U.S. PATENT DOCUMENTS

| | | | |
|---|---|---|---|
| 3,589,091 | 6/1971 | Cloud | 53/556 X |
| 3,672,116 | 6/1972 | Ingmarson | 53/556 |
| 3,910,005 | 10/1975 | Thimon et al. | 53/556 |
| 4,050,221 | 9/1977 | Lancaster et al. | 53/556 |
| 4,077,179 | 3/1978 | Lancaster et al. | 53/556 |

FOREIGN PATENT DOCUMENTS

| | | | |
|---|---|---|---|
| 2281275 | 8/1974 | France | 53/556 |
| 1487512 | 10/1977 | United Kingdom | 53/210 |

*Primary Examiner*—John Sipos

*Attorney, Agent, or Firm*—Price, Heneveld, Huizenga & Cooper

[57] ABSTRACT

Stretch band wrapping apparatus having, in cooperative action with a rotary load support platform and film roll supporting spool, a restraining brake on the spindle, and an elongated, controlled-restraint tension roll intermediate the spindle and platform. The tension roll has a friction surface engaging the width of the film stock unrolled from a roll of film on the spindle, and a restraining brake, the film being kept in engagement with the friction surface by a slight braking action on the spindle, such that a constant tension is applied across the width of the film during stretch wrapping of a load rotating on the platform.

17 Claims, 5 Drawing Figures

FILM WRAP MACHINE

BACKGROUND OF THE INVENTION

This invention relates to equipment for stretch band wrapping pallet loads with stretch film.

Various machines are presently marketed for stretch band wrapping palletized loads with a stretchable polymer. Multiple layers of the polymeric film are wrapped around the load by rotating the load on a platform while restraining the film feed to cause the film to stretch and wrap tightly. The film is supplied from a roll of film initially having a diameter of several inches, typically about 8 to about 20 inches in diameter. The width of the roll or rolls can vary from about 20 inches to 110 inches. The roll is usually positioned on a vertical spindle parallel to the rotational axis of the pallet load.

One known technique for restraining the film is to apply a constant torque braking force to the central rotating spindle that mounts the roll of film. But, as the roll of film decreases in diameter, the tension on the film extending from the periphery of the roll to the load increases. This is undesirable. Because of this characteristic, another technique sometimes employed is that of pressing a plurality of spaced braking wheels against the outer surface of the film roll. But the web portions between the wheels are subjected to different tensile forces than those portions engaged by the wheels, thereby applying undesired diagonal tension forces to the film.

SUMMARY OF THE INVENTION

The present invention constitutes a stretch film wrapping machine which subjects the wrapping film to uniform tension regardless of the diameter of the film roll being unwound, and applies it over the full width of the film stock. A special tension roll is located between the roll support spindle and the load, such having a constant diameter friction surface engaging the width of the unwound film being fed to the revolving load. A braking force applied to the tension roll causes its surface to have a controlled constant braking force applied to the passing film. The film is maintained in engagement with the tension roll friction surface by the support spindle having a restraining brake applying a small constant restraint to prevent excess film unrolling from the roll to maintain the engagement.

DESCRIPTION OF THE PREFERRED EMBODIMENT

Figure 3:
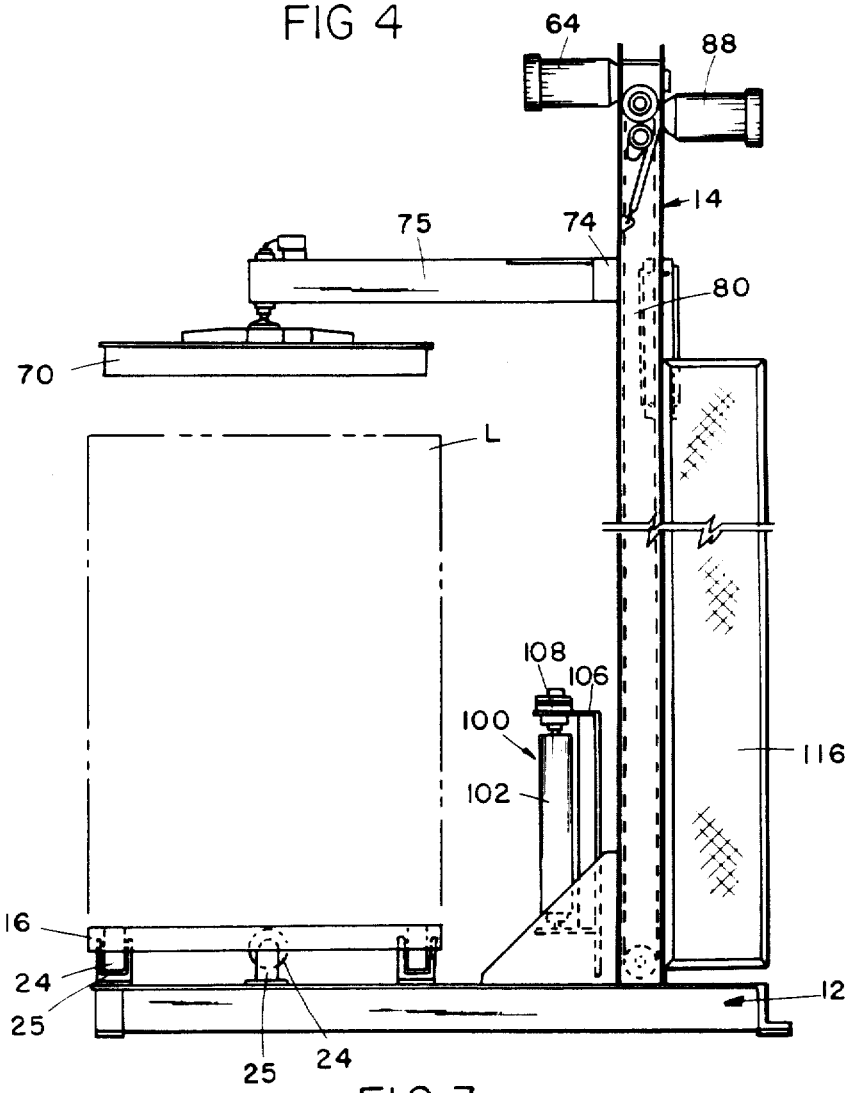
FIG. 3 is a side elevational view of the apparatus, from the opposite side to that viewed in FIG. 1.

Referring now specifically to the drawings, the stretch band wrapping apparatus 10 includes a framework composed of a horizontal base 12 and an upright support 14. The base 12 depicted is basically rectangular, composed of a pair of interconnected parallel legs 13 and 13'. The upright 14 depicted is basically rectangular, having a pair of upright columns 15 and 15' connected by cross beam 17. This can be varied. Mounted on base 12 is a rotational horizontal platform 16. The platform is peripherally supported by a plurality of rollers 24 (FIG. 3) mounted in respective yokes 25.

This platform 16 is forcibly rotated by power rotating means 22 therebeneath such as an electric motor or the equivalent. This rotates shaft 18 at the center of the platform. Platform 16 is adapted to receive a pallet P (FIG. 5) having a load L of stacked cartons or the like thereon, both being placed there by a lift truck, a conveyor, or the equivalent, for stretch band wrapping thereof.

Figure 2:
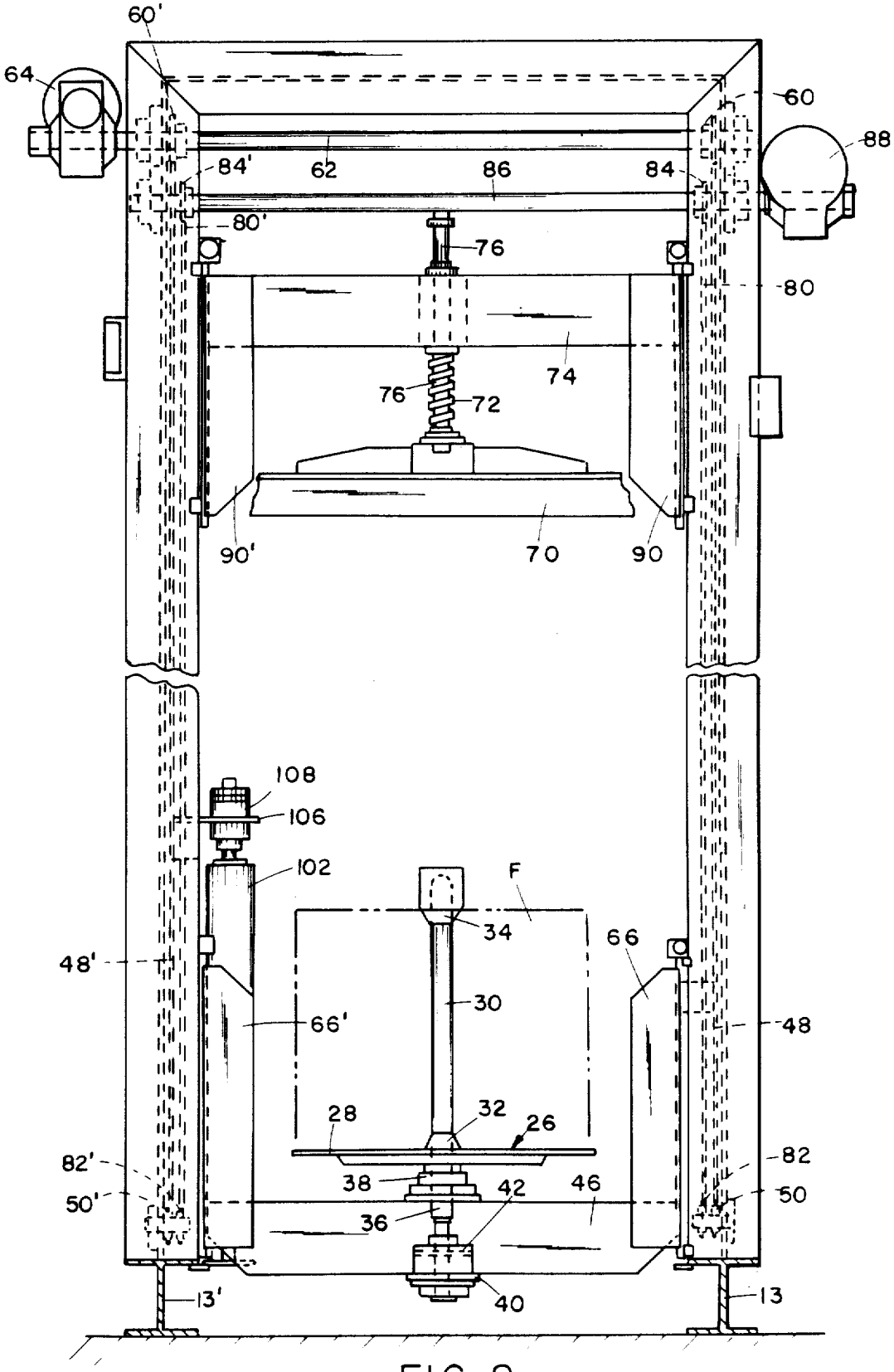
FIG. 2 is a rear elevational view of the apparatus.
Figure 4:
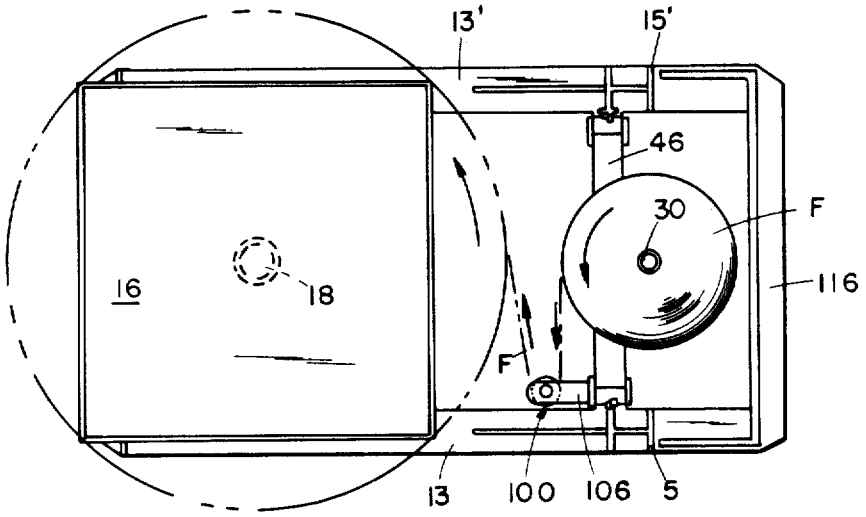
FIG. 4 is a plan view of the apparatus.

Mounted laterally adjacent this platform is a vertical spindle or spool 26 for supporting a roll of stretch film. This spindle includes a lower horizontal support plate 28 and a central upstanding shaft 30 preferably having tapered portions 32 and 34 at the lower and upper ends thereof for interfitting with the central sleeve of the roll of film F (FIG. 4). This spindle is rotational on underlying central shaft 36 supported in an upper anti-friction bearing 38 and on a lower thrust bearing 40. At the base of this shaft, functionally cooperative with the spool, is a restraining brake 42 (FIG. 2). This spindle assembly is supported on a cross beam 46, the ends of which are attached to a pair of roller chains 48 and 48' extending around lower sprockets 50 and 50' and upper sprockets 60 and 60'. The upper sprockets are mounted on a rotational shaft 62 interconnected to a reversible drive motor 64 to raise or lower cross beam 46 within guides 66 and 66' and thereby raise and lower the roll of film F. This enables the spool and film to wrap vertically successive portions of the pallet load in helical overlapping fashion in a manner to be understood from the full description hereof.

Figure 5:
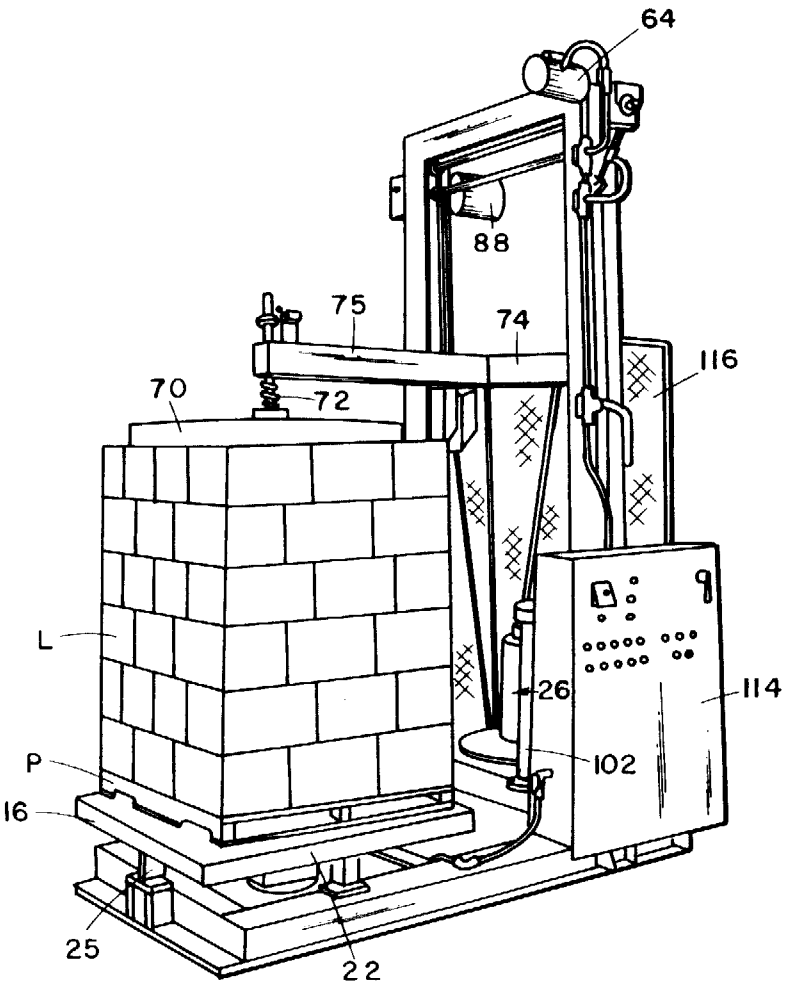
FIG. 5 is a perspective view showing the apparatus with a palletized load to be wrapped.
Figure 1:
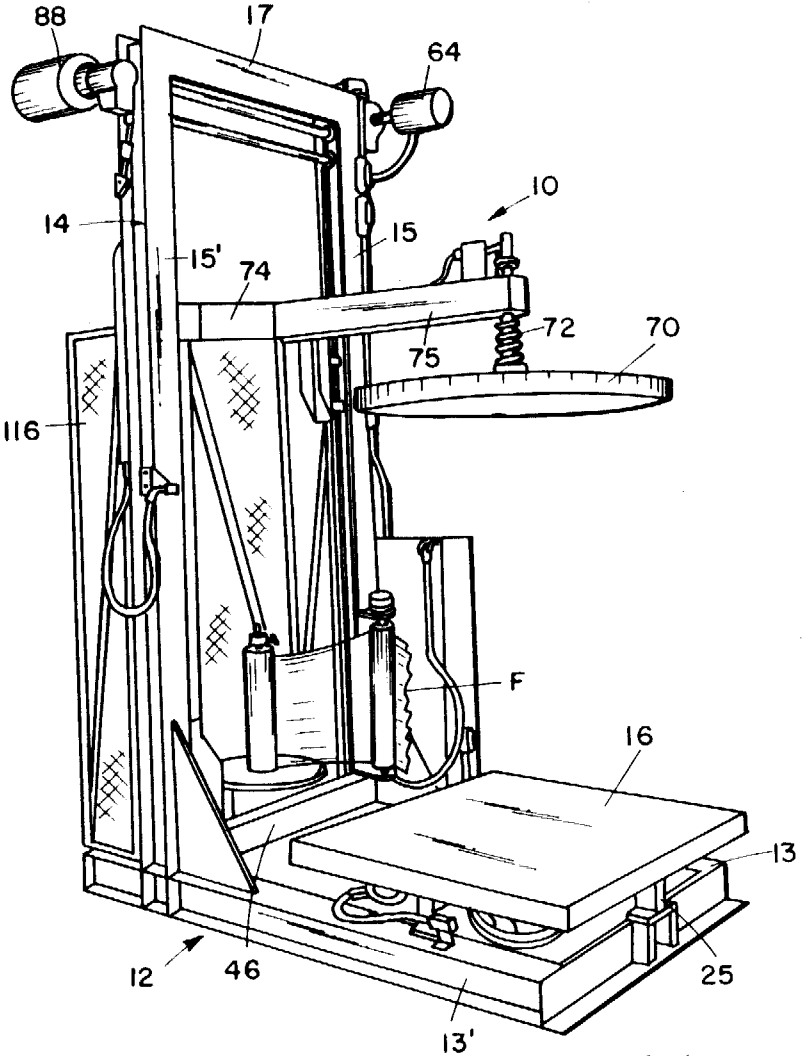
FIG. 1 is a perspecitve view of a preferred form of the novel apparatus viewed from the front and one side.

Above platform 16 and cooperative therewith is an optional upper platen 70 for stabilizing a load on a pallet while being wrapped. This stabilizing unit is vertically shiftable to engage the top of the load as depicted in FIG. 5. When so engaged, it applies a biasing force as a result of a compression coil spring 72 around suspension shaft 76 and between the upper side of platen 70 and the lower side of cantilever beam 75 which extends from cross beam 74 and supports the platen (FIG. 2). Shaft 76 is rotational as well as axially movable in beam 75 to allow the upper platen to rotate with the palletized load during wrapping. The opposite ends of cross beam 74 are supported on a pair of chains 80 and 80' which extend around lower sprockets 82 and 82' and upper sprockets 84 and 84'. The upper sprockets are mounted to a cross shaft 86 suspended in bearings and rotationally driven by a motor and gear box unit 88 which is reversible to raise and lower cross beam 74 within guides 90 and 90'. The cross beam in turn raises and lowers the shaft 76 which supports the depending upper platen.

In this novel apparatus, the special tension roll assembly 100 is positioned to be functionally between the film support spindle and the pallet supporting platform. This assembly includes a vertical tension roll 102 positioned generally between the platform and spindle, but laterally offset therefrom so as to cause the advance path of the film to include a bight at the peripheral surface of the vertical tension roll 102. The film engages a substantial portion of this surface. This peripheral surface constitutes a friction surface. It can be coated with any of a variety of films to have the desired amount of friction to suit the particular film stock. This tension roll assembly is physically supported on the same cross beam 46 as the spindle, causing both to be raised and lowered simultaneously during the stretch band wrapping of the load. This tension roll is mounted in a yoke 106 rotationally supporting the upper and lower ends of the roll. The yoke in turn is attached to the cross beam 46. At the upper end of roll 102 is a variable, electromagnetic, restraining brake 108 controllable as to the degree of resistance applied to resist rotation of this roll as the web is pulled therearound during rotation of the load.

This equipment may be controlled through control panel 114 of coventional type. The structure may also optionally include a protective screen and frame 116 for personnel safety.

In operation, a roll of stretch film stock F is placed on the spool 26 by lowering it down onto the spindle 30 until it rests on plate 28. A palletized load on a pallet P is then placed as by a lift truck on platform 16. If the optional upper platen assembly is employed, it is lowered until platen 70 engages the stacked items and then lowered a small amount more to compress coil spring 76 and thereby apply a controlled bias to the stack. This stabilizer is lowered by operating motor 88 to rotate shaft 86, advance roller chains 84 and 84', cross beam 74 mounted on the chains and thus shaft 76 that supports platen 70.

Film stock is then advanced from the roll on the spindle, around the periphery of tension roll 102 in the manner depicted in FIG. 4, forming a bight to cause maximum engagement of the film stock with the roll for the governing effect described hereinafter. The film is then held in engagement with the palletized load L, e.g. manually, while the load is rotated with motor 22 until at least one complete wrap has been made. During this time, the braking action on the spindle prevents uncontrolled unwinding of the film from the roll of film F. After a complete revolution of the wrapped film on the stack, typically at the bottom, the electromagnetic brake 108 on the tension roll is activated to apply a predetermined restraining force while the platform and palletized load thereon continue to be rotated, using the gear motor 22.

The restraining effect of tension roll 102 has a constant restraining force on the stretch film being wrapped around the load. Thus, even though the diameter of the roll from which the film is being taken constantly decreases, the stress applied to the film actually being stretched remains constant. The braking action applied to the spool and thus to the roll of film is just sufficient to prevent uncontrolled unwinding of the film. The combination of these components prevents constantly changing tension being applied to the stretch film. In the form of the apparatus depicted, the stretch banding operation proceeds by causing the spinlde with its roll thereon, and the tension roll, to vertically raise and thereby feed the stretch film to vertically successive portions of the load for band wrapping the entire load from the bottom to the top and then preferably reversing to again wrap from the top to the bottom.

When the complete load is wrapped, the brake for the spindle is actuated to stop the spindle completely and thereby cause the stretch film to snap at a controlled location, whereupon the vertical stabilizer 70 is raised and the wrapped palletized load can be removed by a lift truck from the apparatus.

It is recognized that the specific physical embodiment of the overall structure may be varied somewhat to suit the particular circumstances and design requirements. Thus, in some instances it is not always necessary to employ the upper stabilizer platen. Further, the pair of upright columns 15 and 15' can be substituted by a single column having a chain to drive the support element for the spindle and tension roll during the vertical movement thereof. It is possible for some operations to have the film spindle and film roll thereon stay vertically stationary. The tension roll can also be kept vertically stationary. There can be more than one film roll spindle, e.g. two, offset vertically of each other, to supply film for wrapping at different vertical levels. These can use the same tension roll by being of a length to overlap both film rolls so that two lengths of film extend around the same tension roll and onto the stacked load of articles on the platform. These are some illustrative variations.

The embodiments of the invention in which an exclusive property or privilege is claimed are defined as follows:

1. A method for peripherally stretch-wrapping pallet loads with polymeric film by rotating a load support platform supporting a pallet load and allowing film to unroll from a support spindle whose axis bears a parallel orientation relative to the axis of said load platform, said method including: operably connecting restraining means to said spindle and thereby preventing unrestrained unrolling of film positioned thereon; providing a tension roll free of engagement with any other roll between said spindle and said load platform and locating said tension roll laterally offset from and parallel to said platform and spindle axes; pulling film off said spindle, over said tension roll and around the pallet load, without passing it through any compression rolls, by rotating said load platform; restraining said tension roll and regulating the rate of rotation thereof by operably connecting tension roll control means thereto to thereby maintain regulated tension on the film being wrapped.

2. The method fo claim 1 wherein step of restraining said tension roll comprises connecting an electromagnetic brake to said tension roll.

3. The method of claim 1 in which said tension roll is provided with a friction surface.

4. The method of claim 1 which includes providing a rotational load stabilizer shiftable toward said platform to engage a load thereon and having an axis of rotation coaxial with said platform axis to rotate with said platform and a load thereon; and providing biasing means on said load stabilizer for causing said stabilizer to apply a biasing force to the load.

5. The method of claim 1 wherein said spindle is axially shifted along with said film roll to progressively wrap vertically successive portions of the load.

6. The method of claim 1 which includes providing said tension roll with a length extending the full length of said spindle to enable engagement of the full width of the film stock unrolled from the spindle.

7. Apparatus for peripherally stretch-wrapping pallet loads with polymeric film and including a powered rotational load support platform rotatable on an axis to rotate a pallet load, and a spindle for supporting a film roll to allow the film roll to unroll about an axis for wrapping of the pallet load, the apparatus comprising:

in combination with said support and said spindle; restraining means operably connected to said spindle for preventing unrestricted unrolling of a film roll thereon; an elongated tension roll generally between said platform and said spindle, having a control surface for engaging film extending from a film roll on said spindle to a load on said platform, said tension roll being rotatable about an axis parallel to said support platform axis and said film roll axis, and laterally offset relative to said platform and spindle axes to cause the film to include a bight at said tension roll control surface, said tension roll control surface being free of engagement with any other roll and being rotated by film pulled by the load on said platform; said apparatus being free of compression rolls through which film passes, and tension control means operably connected to said tension roll for applying controlled rotation restraint to said tension roll control surface to regulate the rate of rotation of said tension roll by the film pulled past it and thereby maintain regulated tension on the film being wrapped around a pallet load without passing said film through compression rolls of any type.

8. The apparatus in claim 7 wherein said tension control means for applying a controlled rotation restraint comprises an electromagnetic brake for said tension roll.

9. The apparatus in claim 7 wherein said spindle is axially shiftable along said film roll axis to progressively wrap vertically successive portions of the load.

10. The apparatus in clam 7 wherein said control surface on said tension roll comprises a friction surface.

11. The apparatus in claim 7 wherein said tension roll extends the full length of said spindle to enable engagement of the full width of film stock unrolled from the spindle.

12. The apparatus in claim 7 including:

a rotational load stabilizer shiftable toward said platform to engage a load thereon, and having an axis of rotation coaxial with said platform axis to rotate with said platform and a load thereon, and biasing means on said load stabilizer for causing said stabilizer to apply a biasing force to the load.

13. Apparatus for peripherally stretch-wrapping pallet loads with polymeric film and including a powered rotational load support platform rotatable on an axis to rotate a pallet load, and a spindle for supporting a film roll to allow the film roll to unroll about an axis for wrapping of the pallet load, the apparatus comprising:

an elongated tension roll having a web engagement friction surface for engaging film extending from a film roll on said spindle to a load on said platform; said tension roll being free of engagement with any other roll and being positioned generally between said rotational platform and said spindle, but laterally offset therefrom to form a bight in the film to maintain the film in engagement with a substantial portion of said friction surface to cause rotation of said tension roll by film advancing in engagement with said friction surface; said apparatus being free of compression rolls through which said film passes; and tension control restraining means at said tension roll for maintaining constant tension on film engaging said friction surface as it is advanced to be wrapped around a pallet load without passing said film through compression rolls of any type.

14. The apparatus in claim 13 wherein;

said tension roll restraining means compises a brake on said tension roll.

15. The apparatus in claim 13 wherein said means for maintaining the film in engagement with said friction surface includes a restraining brake for said spindle.

16. The apparatus in claim 13 including means for vertically shifting said film roll spindle to raise and lower said spindle and film thereon for wrapping successive vertical portions of a pallet load.

17. The apparatus in claim 16 including means for vertically shifting said tension roll to raise and lower said tension roll with raising and lowering of said spindle.

* * * * *

UNITED STATES PATENT AND TRADEMARK OFFICE

CERTIFICATE OF CORRECTION

PATENT NO. : 4,502,264

DATED : March 5, 1985

INVENTOR(S) : Anthony H. Flaherty

It is certified that error appears in the above-identified patent and that said Letters Patent is hereby corrected as shown below:

Column 3, line 11:

"coventional" should be --conventional--

Column 3, line 53:

"spinlde" should be --spindle--

Column 4, line 38, Claim 2:

"fo" should be --of--

Column 5, line 26, Claim 10:

"clam" should be --claim--

Column 6, line 25, Claim 14:

"compises" should be --comprises--

Signed and Sealed this

*Third* Day of *September 1985*

[SEAL]

*Attest:*

DONALD J. QUIGG

*Attesting Officer* *Acting Commissioner of Patents and Trademarks - Designate*